United States Patent [19]

Corbo

[11] 4,387,535

[45] Jun. 14, 1983

[54] ADJUSTABLE THRESHOLD ASSEMBLY

[75] Inventor: Thomas A. Corbo, University Heights, Ohio

[73] Assignee: Manco Tape, Inc., Cleveland, Ohio

[21] Appl. No.: 328,200

[22] Filed: Dec. 7, 1981

[51] Int. Cl.[3] ..... E06B 1/70

[52] U.S. Cl. ..... 49/468; 49/469

[58] Field of Search ..... 49/468, 469, 482

[56] References Cited

U.S. PATENT DOCUMENTS

| | | | |
|---|---|---|---|
| 2,947,043 | 8/1960 | Klemma | 49/468 |
| 3,374,479 | 3/1969 | Neff | 49/468 |
| 3,762,100 | 10/1973 | Kempel | 49/468 |
| 3,962,828 | 6/1976 | McAllister | 49/468 |
| 4,074,464 | 2/1978 | McCay | 49/468 |
| 4,104,830 | 8/1978 | Eagle | 49/468 |
| 4,156,325 | 5/1979 | McMullen et al. | 49/468 |
| 4,213,275 | 7/1980 | Oehmig | 49/468 |
| 4,352,258 | 10/1982 | Bursk et al. | 49/468 |

*Primary Examiner*—Philip C. Kannan

*Attorney, Agent, or Firm*—Body, Vickers & Daniels

[57] ABSTRACT

An adjustable threshold assembly of simple construction and inexpensive to manufacture includes a bar member vertically adjustable in a channelway of a base member. A plurality of threshold height adjusting screws extend vertically downward through openings in a transverse bridge wall of the bar member and between and in self-tapped screw thread-like engagement with a pair of longitudinally extending opposed vertical walls of the bridge wall. The facing vertical sides of the opposed walls are advantageously formed with longitudinally extending extruded serrations of a cross-sectional shape approximately matching the cross-sectional shape of the screw threads of the adjusting screws to facilitate self-tapping of the adjusting screws into the opposed walls of the bar member.

8 Claims, 5 Drawing Figures

FIG. 3
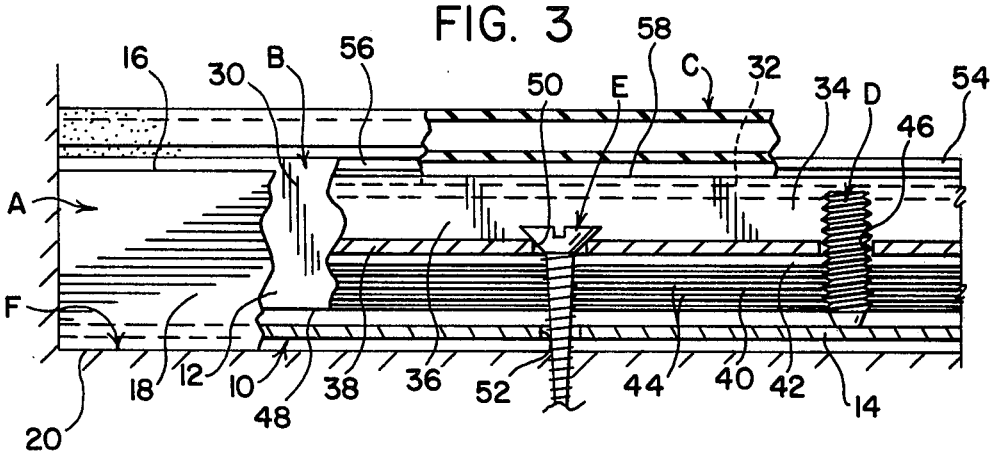
FIG. 4
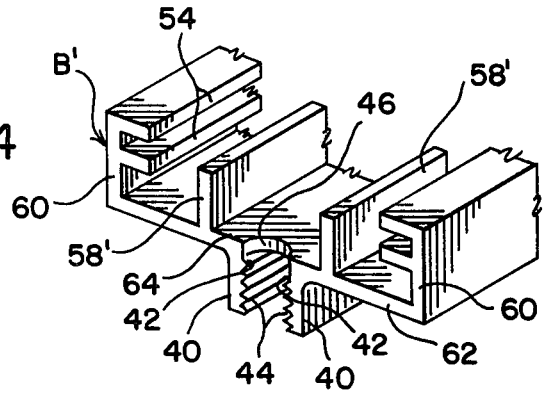
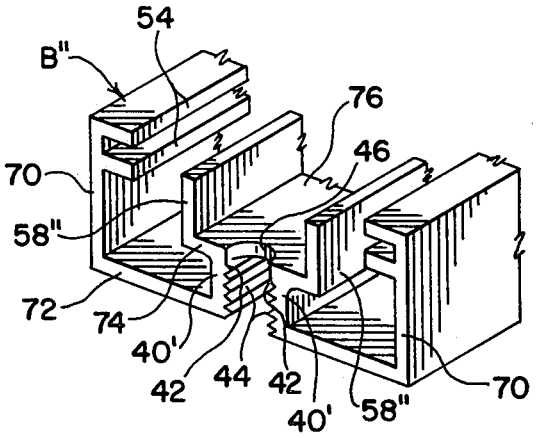
FIG. 5

ADJUSTABLE THRESHOLD ASSEMBLY

This invention relates to an adjustable threshold assembly for doorways, and more particularly to a threshold assembly which may be adjusted in height to provide proper sealing engagement with the bottom of a door.

BACKGROUND

Adjustable threshold assemblies for doorways are well known in the art and have generally comprised an assembly of an elongated threshold or bar member which is vertically adjustable in an elongated base member and carries a deformable top sealing strip for sealing engagement with the lower edge of a closed door. The base and bar members are commonly formed of thin-walled material, such as aluminum extrudings, with wall thicknesses on the order of 1/16" or so, and the vertical adjustment of the bar member relative to the base member is generally effected by the rotation of adjusting screws which are screw-threaded into threaded openings in a horizontal wall of one of the members and bear against an opposing wall of the other member.

Because of the thin-walled character of the base and bar members of such assemblies, however, it has been found generally necessary, in order to provide a sufficiently supportive screw-threaded engagement or purchase of the adjusting screws with the wall into which they are threaded, to stake or otherwise fasten into the wall a threaded bushing or socket of extended thread length for each of the adjusting screws. Such added bushing members and insertion operations, however, add materially to the number of component parts and to the cost and time required for the manufacture of such assemblies.

Other forms of known adjustable assemblies have employed base or threshold members having either a comparatively thick wall section for the adjusting screws to thread into, or have employed different forms of height adjusting means such as, for instance, cooperating pairs of height-altering wedge members for supporting the threshold bar member which are relatively adjustable longitudinally of the threshold assembly to alter the height of the threshold member. Because of their aforementioned thicker wall construction for the adjusting screws, or their additional components, such other forms of adjustable threshold assemblies are also comparatively costly to manufacture and cumbersome to handle.

SUMMARY OF INVENTION

The present invention contemplates a new and improved adjustable threshold assembly which overcomes all of the above referred to and other problems of prior such assemblies, and provides a threshold assembly which is of simple constuction and effective in operation and which is comparatively inexpensive to fabricate.

Briefly, in accordance with one aspect of the invention, an adjustable threshold assembly of the above described general type is provided wherein the vertically adjustable threshold bar member is comprised of an elongated extruded metal member having a pair of closely spaced longitudinally-extending parallel inner walls which extend vertically from a transverse wall of the bar member and between which the adjusting screws extend vertically downward and have an adjustable engagement therewith for adjusting the vertical position or height of the bar member relative to the base member of the assembly.

In accordance with a further aspect of the invention, the facing sides of the opposed parallel walls of the bar member have longitudinally-extending serrations extruded therein of a cross-sectional shape approximately matching the cross-sectional shape of the screw threads on the adjusting screws, and the facing serrated sides of the opposed parallel walls are spaced apart a distance approximately matching the diameter across the screw threads on the adjusting screws so as to facilitate self-tapping screw thread-like engagement of the adjusting screws with the facing serrated sides of the opposed walls to enable the adjustment of the vertical position of the bar member relative to the base member of the assembly.

OBJECTS

It is a principle object of the invention to provide a new and improved adjustable threshold assembly of the type described which overcomes the problems of the prior art and is of simple construction and easy and inexpensive to manufacture.

Another object of the invention is to provide a new and improved adjustable threshold assembly of the type described having an extruded bar member formed, as extruded, with engagement means for coating with the screw threads of height adjusting screws to vertically adjust the bar member.

Still another object of the invention is to provide a new and improved adjustable threshold assembly of the type described having an extruded thin-walled bar member which does not require the mounting of any threaded inserts or bushings in the bar member for screw thread engagement with the height adjusting screws of the assembly.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein:

FIG. 3 is a longitudinal sectional view taken on the line 3—3 of FIG. 2;

FIG. 4 is a fragmentary perspective view of a modified form of adjustable bar member for an adjustable threshold assembly according to the invention; and, FIG. 5 is a fragmentary perspective view of another modified form of adjustable bar member for an adjustable threshold assembly according to the invention.

PREFERRED EMBODIMENTS

Figure 1:
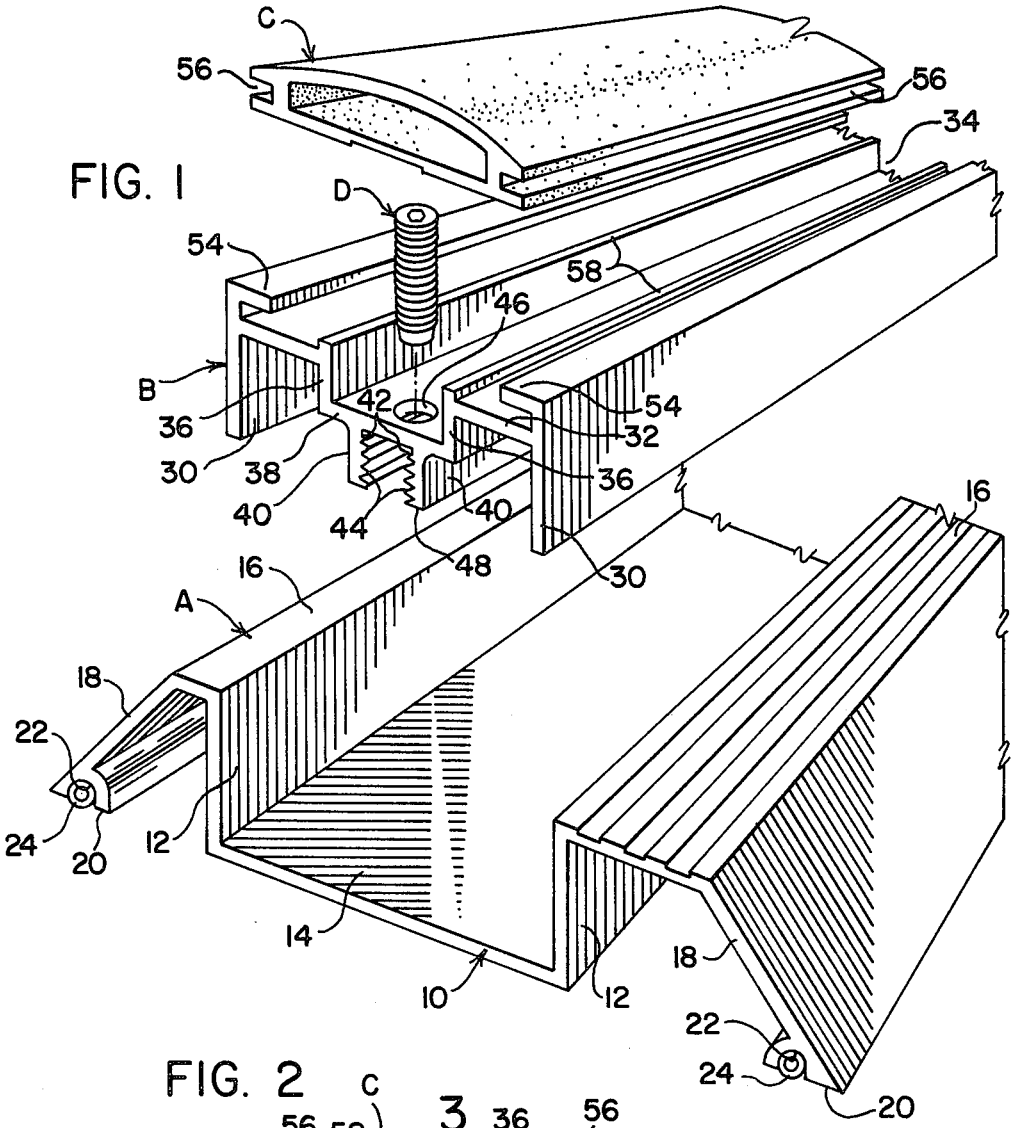
FIG. 1 is a fragmentary exploded perspective view of an adjustable threshold assembly according to the invention.

Referring now to the drawings wherein the showings are for the purposes of illustrating preferred embodiments of the invention only and not for the purposes of limiting same, the adjustable threshold assembly according to the invention is essentially comprised of an elongated base or body member A for fastening to the floor F of a doorway to underlie a door when closed, and an elongated adjustable bar or threshold member B which is mounted in the base member A for vertical adjustment movement therein. The bar member B is provided with an attached transversely-crowned yieldable sealing or cover strip C of resilient deformable material, such as a vinyl plastic, to provide a close seal with the bottom edge of the door when closed. The bar member B is also provided with a plurality of vertically extending height adjusting screws D for adjusting the vertical height of the bar member relative to the base member A, and the assembly of the base member A and the bar member B with its attached yieldable cover strip C and height adjusting screws D is adapted to be fastened to the doorway floor F by a plurality of fastening screws E (FIG. 3).

The elongated base or body member A may conveniently be extruded from a suitable metallic material such as aluminum or other metal with wall thicknesses of, for example, around 1/16" or so, and it is comprised of a central longitudinal channel portion 10 opening upwardly and formed by a pair of parallel, vertically disposed opposed side walls 12 and a connecting horizontally disposed bottom wall 14. The extruded base member A also includes a pair of top wall portions 16 connected to and extending horizontally outward from the upper ends of the side walls 12 of the channel portion 10 at the opposite sides thereof, and a pair of downwardly and outwardly inclined outer side walls 18 extending from the top wall portions 16. The lower edges 20 of the inclined side walls 18 are horizontally coplanar with each other and lie in a horizontal plane a small distance, e.g., 0.005" or so, below the horizontal plane of the lower surface of the horizontal bottom wall 14 of the channel portion 10. The lower edges 20 of the inclined outer side walls 18 are each formed with a U-shaped longitudinally-extending groove 22 to receive a resilient sealing strip or tubing 24, such as vinyl tubing, to engage and provide an effective seal with the floor F. The base member A is firmly secured to the floor F along with the bar member B by the fastening screws E to compress and seal the sealing strips or tubing 24 against the floor.

The adjustable bar member B comprises an extruded metal member formed from a suitable metallic material such as aluminum or other metal, with wall thicknesses of around 1/16" or so similar to those of the base member A. In the preferred embodiment of the invention shown in FIGS. 1–3, the elongated bar member B is in the form of a generally inverted downwardly opening channel-shaped member formed by a pair of parallel, vertically disposed opposed outer side walls 30 and a transverse connecting or bridge wall 32. The bridge wall 32 is offset downwardly throughout its length to form a longitudinally extending upwardly-opening channelway 34 preferably located centrally between the outer side walls 30 and formed by depending spaced intermediate side walls 36 and a connecting bottom wall 38. The channelway 34 accommodates therein the upper ends of the height adjusting screws D which project above the bridge wall 32 when these screws are in their retracted position.

In accordance with the invention, the extruded adjustable bar member B is formed with a pair of longitudinally extending parallel inner walls 40 depending from the downwardly offset portion 38 of the bridge wall 32 in spaced side-by-side relation and preferably located centrally between the outer walls 30 of the bar member. The facing inner sides 42 of these inner walls 40 are advantageously extruded with longitudinal serrations or corrugations 44 of a cross-sectional shape approximately matching the cross-sectional shape of the screw threads on the adjusting screws D, and with the facing serrated portions 44 of the walls 40 spaced apart a distance matching the distance between diametrically opposite sides of the height adjusting screws D so as to facilitate the self-tapping screw thread-like engagement of the screws D with the walls 40 when the adjusting screws are inserted down therebetween and rotated. Suitable openings 46 are provided in the bridge wall 38 at spaced points therealong to permit the downward insertion of the adjusting screws D through the bridge wall 38 for such screw thread-like engagement with the facing serrated inner sides 44 of the walls 40.

In the installation of the threshold assembly comprising the invention in a doorway, the height adjusting screws D are screwed down between and self tapped into the walls 40 of the bar member B so as to project downwardly beyond the bottom edges 48 of the walls 40 and bear at their lower ends against the bottom wall 14 of the channel portion 10 of the base member A. By then rotating the inserted height adjusting screws D one way or the other, as by means of a screwdriver or Allen type wrench inserted in the channelway 34 and engaged with the kerfed or Allen socket-containing upper ends of the adjusting screws within the channelway 34, the bar member B can then be set in the required selected vertical position relative to the base member A, as determined by the engagement of the lower ends of the height adjusting screws with the wall 14 of the base member, to form an effective seal with the bottom edge of a door when closed to overlie the threshold assembly.

The assembly of the base member A and bar member B is secured in proper place on the floor F across the doorway by a plurality of fastening or anchor screws E (FIG. 3) which are inserted down through registered openings 50 and 52 respectively provided in the bridge wall 38 of the bar member and in the bottom wall 14 of the base member and which are screwed or otherwise fastened down into the floor. The fastening screws E hold the bar member B down in the channel 10 with its height adjusting screws D bearing at their lower ends against the bottom wall 14 of the base member A to thus forcibly clamp the latter down against the floor F with the sealing strips 24 on the base member compressed between and sealing the space between the floor and the lower edges 20 of the inclined side walls 18 of the base member. In this connection, the vertical adjustment and positioning of the bar member B in its selected vertical position relative to the base member A should be made prior to the final fastening down of the threshold assembly to the floor F since otherwise any necessary upward adjustment of the bar member relative to the base member then would first require the unloosening of the fastening screws in order to permit such upward adjustment of the bar member.

The bar member B is provided with a top sealing strip C of a suitable resilient deformable or yieldable material, such as a vinyl plastic for example, to form a proper seal with the bottom edge of an overlying door. As in the particular case illustrated, the sealing strip C is preferably in the form of a transversely upwardly crowned flat-shaped hollow strip to afford a substantial degree of vertical yieldability for proper sealing engagement with the door. The sealing strip C is disengageably secured along its opposite side edges to the top of the bar member A so as to overlie it throughout its length. For this purpose, the bar member B may be provided along its top side edges with inturned lips 54 for snugly fitting into matching longitudinal grooves 56 in the side edges of the sealing strip C. To mount the resilient sealing strip C on the bar member B, the sealing strip may be transversely contracted manually to enable passage down between the inturned lips 54 on the bar member, whereupon the sealing strip is then released to allow it to return to its normal width with the inturned lips 54 engaged in the grooves 56 in the side edges of the sealing strip to secure it in place on the bar member B. Alternatively, the sealing strip C may be first positioned with one of the inturned lips 54 of the bar member B inserted in place in the groove 56 all along one side of the sealing strip and then the opposite side of the sealing strip manually pressed both inwardly and downwardly to cause it to snap in place with the other inturned lip 54 of the bar member inserted in place in the groove 56 along the other side of the sealing strip. To assist in maintaining the upwardly-crowned shape of the sealing strip C on the bar member B, the latter may be provided with a pair of longitudinally extending vertical walls 58 upstanding from the bridge wall 32 thereof and each spaced a short distance inwardly from the inturned lips 54 on the bar member for engaging with the underside of the sealing strip and holding it in an upwardly-arched or crowned position overlying the bar member.

Figure 2:
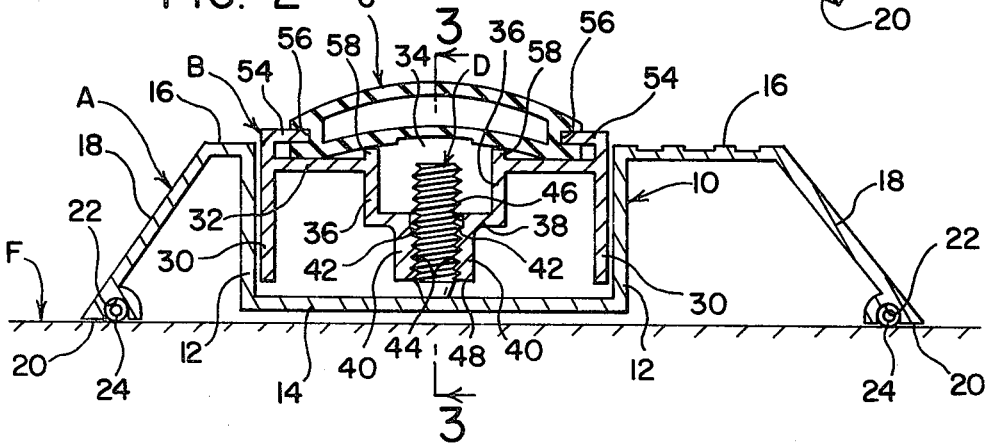
FIG. 2 is a transverse sectional view of the assembly according to the invention.

The modified embodiment of the invention shown in FIG. 4 differs from the preferred embodiment of FIGS. 1–3 only in the form of the extruded bar member B'. In FIG. 4, the bar member B' comprises an upwardly-opening channel-shaped member instead of an inverted downwardly-opening channel member as in FIGS. 1–3, and it is formed by a pair of parallel, vertically disposed side walls 60 upstanding from and connected by a bridge wall 62. The opposed walls 40, having the extruded serrations 44 on their facing inner sides, depend directly from the bridge wall 62, and the upstanding walls 58' on the bridge wall for engaging with the underside of the upwardly-arched sealing strip C are made of sufficiently greater height to effect such engagement. The walls 58' also form with the bridge wall 62 a longitudinal upwardly-opening channelway 64 on the bar member B', similar to the channelway 34 in FIGS. 1–3, for the accommodation therein of the upper ends of the height adjusting screws D in the retracted positions thereof in the bar member.

The modification of the invention shown in FIG. 5 likewise differs from FIGS. 1–3 only in the form of the extruded bar member B'' which, like the bar member B' of FIG. 4, comprises an upwardly-opening channel-shaped member formed by a pair of parallel, vertically disposed side walls 70 upstanding from and connected by a bottom bridge wall 72. The principal difference in the form of the bar member B'' over that of the bar members B and B' in FIGS. 1–3 and 4 is in the form of the opposed, serrated inner walls 40' which in this case are formed by upstanding portions of the bridge wall 72 of the bar member B'' instead of by separate wall members depending from the corresponding bridge walls 32, 38 or 62 of the bar members B and B'. The upstanding serrated wall portions 40' are bridged at their upper ends by a connecting upwardly-offset horizontal wall portion 74 of the bridge wall 72, which offset wall portion is provided with the openings 46 and 50 for the height adjusting screws D and the fastening screws E, respectively. The offset horizontal wall portion 74 is extended laterally outward from the upper end of each of the upstanding wall portions 40' and is provided along its side edges with upstanding flanges 58'' which serve the same function as the upstanding walls 58 and 58' of FIGS. 1–3 and 4 to engage with the underside of the yieldable sealing strip C to assist in maintaining the upwardly-arched shape thereof. The flanges 58'' also form, along with the bridge wall portion 74, a longitudinal upwardly-opening channelway 76 on the bar member B'', similar to the channelways 34 and 64 in FIGS. 1–3 and 4, for the accommodation therein of the upper ends of the height adjusting screws D in the retracted positions thereof in the bar member.

The invention has been described with reference to preferred embodiments thereof. Obviously, modifications and alterations will occur to others upon the reading and understanding of this specification. It is my intention to include all such modifications and alterations insofar as they come within the scope of the appended claims or the equivalents thereof.

Having thus described the invention, it is claimed:

1. An adjustable threshold assembly comprising an elongated base member adapted to rest upon and be secured to a floor, said base member being provided with an upwardly-opening longitudinal channel comprised of parallel vertical side walls and a connecting horizontal bottom wall, an extruded elongated metal bar insert member extending longitudinally within and vertically adjustable in said channel and having vertical outer side walls connected by a transverse bridge wall, an elongated transversely upwardly-arched sealing strip of resilient deformable material extending along and overlying the bridge wall of and disengageably secured along its opposite side edges to said bar member, said bar member having a pair of longitudinally extending parallel inner walls extending vertically from the bridge wall in spaced side-by-side relationship, and a plurality of height adjusting screws extending vertically downward through openings in said bridge wall and through the space between and in self-tapped screw thread-like engagement with said inner walls at spaced points thereabong to bear at their lower ends against the bottom wall of said channel, the facing inner sides of the said inner walls having longitudinally extending extruded serrations therein of a cross-sectional shape approximately matching the cross-sectional shape of the screw threads of said adjusting screws to facilitate the self-tapping of the adjusting screws into said screw thread-like engagement with said inner walls.

2. An adjustable threshold assembly as specified in claim 1 wherein the said inner walls of said bar member depend from the bridge wall thereof.

3. An adjustable threshold assembly as specified in claim 1 wherein the said inner walls of said bar member comprise upstanding portions of the bridge wall thereof.

4. An adjustable threshold assembly as specified in claim 2 wherein both said outer and inner walls of said bar member depend from the bridge wall thereof.

5. An adjustable threshold assembly as specified in claim 3 wherein both said outer and inner walls of said bar member are upstanding from at least portions of the bridge wall thereof.

6. An adjustable threshold assembly as specified in claim 1 wherein the said pair of inner walls of said bar member are located approximately centrally between the said outer side walls thereof.

7. An adjustable threshold assembly as specified in claim 1 wherein the said bottom wall of said base member and the said bridge wall of said bar member are provided with a plurality of registerable apertures at spaced points therealong for the reception of fastening screws for holding the bar member tightly down with its said adjusting screws bearing against the bottom wall of the base member channel and fastening the assembly to the floor.

8. An adjustable threshold assembly as specified in claim 1 wherein the said base member is provided with downwardly and outwardly sloped outer walls at the opposite sides of and enclosing therebetween the said channel of said base member, said sloping outer walls having free bottom edge portions defining a horizontal plane spaced a slight distance below the horizontal plane of the bottom surface of the said bottom wall of said channel.

* * * * *